US007010142B2

(12) United States Patent
Kuwabara et al.

(10) Patent No.: US 7,010,142 B2
(45) Date of Patent: Mar. 7, 2006

(54) ELECTRICAL ACOUSTIC CONVERTER

(75) Inventors: Atsushi Kuwabara, Yamanashi (JP); Akira Yoneyama, Yamanashi (JP); Yoshizumi Ohta, Yamanashi (JP); Terumi Kobayashi, Yamanashi (JP)

(73) Assignee: Citizen Electronics Co., Ltd., Yamanashi (JP)

( * ) Notice: Subject to any disclaimer, the term of this patent is extended or adjusted under 35 U.S.C. 154(b) by 119 days.

(21) Appl. No.: 10/720,188

(22) Filed: Nov. 25, 2003

(65) Prior Publication Data

US 2004/0105564 A1 Jun. 3, 2004

(30) Foreign Application Priority Data

Nov. 26, 2002 (JP) ..... 2002-343108

(51) Int. Cl.
*H04R 25/00* (2006.01)

(52) U.S. Cl. ..... 381/409; 381/410

(58) Field of Classification Search ..... 381/151, 381/394, 395, 396, 409, 410; 340/384.1, 340/388.1, 388.3, 388.4, 388.5, 311.1, 391.1, 340/825, 407, 407.1, 44, 825.41, 390.1, 392.1, 340/392.2; 379/433; 367/17.5; 439/86, 439/492

See application file for complete search history.

(56) References Cited

U.S. PATENT DOCUMENTS 6,526,152 B1 * 2/2003 Frasl ..... 381/409
6,704,430 B1 * 3/2004 Imahori et al. ..... 381/396

FOREIGN PATENT DOCUMENTS

JP 2001-306077 11/2001

* cited by examiner

*Primary Examiner*—Sinh Tran
*Assistant Examiner*—Brian Ensey
(74) *Attorney, Agent, or Firm*—Browdy and Neimark, PLLC

(57) ABSTRACT

Disposed within a space formed between a base cover (2) and a top cover (1) attached to the base cover (2) is an electromagnetic sound generating part which has a diaphragm (9) attached to the base cover (2) and a drive part causing the diaphragm (9) to vibrate. The drive part includes a yoke (5) fitted in the base cover (2), a magnet (7) mounted on the yoke (5), a top plate (8) mounted on the magnet (7) and an exciting coil (6) disposed to oppose to side surfaces of the magnet (7) and top plate (8). Coil contact springs (10) are contained into housings (2*a*) provided on portions of the base cover inside than an outer peripheral edge of the diaphragm. The coil contact springs (10) act to connect the exciting coil (6) with an outside power source. The base cover (2) is provided with a pair of connecting pieces (11) or lead frames which are used to connect the exciting coil (6) and coil contact springs (10). The connecting pieces (11) are embedded in the base cover (2).

7 Claims, 6 Drawing Sheets

ELECTRICAL ACOUSTIC CONVERTER

BACKGROUND OF THE INVENTION

1. Field of the Invention

The present invention relates to an electrical acoustic converter for generating a sound by vibrating a diaphragm by an electromagnet, more particularly, to a compact and thin-shaped electrical acoustic converter suitable for being mounted on a printed-circuit board or the like.

2. Description of the Prior Art

Recently, an electromagnetic sounder or electrical acoustic converter of a surface-mounted type, such as a miniature buzzer mounted directly on a printed-circuit board, becomes mainstream pursuant to increment of a surface-mounted technology of miniature electronic parts.

Therefore, a great number of electrical acoustic converters are used in a field of conductive-type speakers and multiple function-type speakers assembled in a mobile communication device such as a cellular phone.

A conventional electromagnetic sounder has coil contact springs provided outside an outer peripheral edge of a diaphragm for connecting an exciting coil with an outside power source, and the coil contact springs has terminals extending perpendicularly, as shown in Japanese Patent Laid Open 2001-306077, for example.

A typical example of a conventional electromagnetic-type sounder is illustrated in FIGS. 5 and 6. The electromagnetic-type sounder includes a case body 20 having a base cover 22 and a top cover 21 attached to the base cover 22. A sound-discharging hole 23 is provided between the top and base covers 21 and 22. A yoke 24 of a magnetic material is installed on a central portion of the base cover 22. The yoke 24 is provided at a center thereof with a center core 24*a*, and is formed at a portion of an outer periphery thereof with a cutout 24*b*, as shown in FIG. 5. An exciting coil 25 is disposed to surround the center core 24*a*.

Disposed outside the exciting coil 25 is an annular magnet 26 having a cutout 26*a* provided to oppose the cutout 24*b*. A thin circular plate-shaped diaphragm 27 of a stainless material or the like is fixed on an upper surface of the base cover 22.

A circular plate-shaped exciting piece 28 of a magnetic material is fixed on a central portion of the diaphragm 27. A pair of lead frames 29 is embedded in the base cover 22 by insert mould. The lead frames 29 connect terminals 25*a* extending from a winding wire of the exciting coil 25 with outside connecting terminals (not shown).

One end of each lead frame 29 forms a terminal 29*a* being exposed from an upper surface of the base cover 22 at the cutout 24*b* of the yoke 24 and another end 29*b* of the lead frame 29 is disposed to be exposed within each of a pair of coil spring housings 22*b* formed outside the base cover 22.

The terminals 25*a* of the exciting coil 25 are electrically connected with the terminals 29*a* of the lead frames 29 by soldering or the like.

Coil contact springs 30 are inserted into the coil spring housings 22*b* to act as outside connecting terminals. A contact portion 30*a* of each of the coil contact springs 30 is electrically connected with the another end 29*b* of each lead frame 29 by soldering or the like, and a terminal 30*b* of each of the coil contact springs 30 is projected outwardly from the coil spring housing to connect with an outside part (not shown).

The coil spring housings 22*b* are formed outside an outside peripheral edge of the diaphragm 27.

In the electrical acoustic converter as described above, as a current is applied through coil contact springs 30 to the exciting coil 25 to excite it, a magnetic circuit passing the exciting coil 25, yoke 24, magnet 26 and exciting piece 28 is formed so that the exciting piece 28 is absorbed to the center core 24*a* to vibrate the diaphragm 27, thus making a sound. The generated sound is discharged passing through the sound-discharging hole 23 from a sound box formed by a space between the top cover 21 and diaphragm 27.

However, there is a problem in the above conventional acoustic converter that a compact and thinned electrical acoustic converter cannot be obtained because the coil contact springs are disposed outside the outer peripheral edge of the diaphragm, and furthermore because the terminals of the coil contact springs are extended perpendicularly.

SUMMARY OF THE INVENTION

The present invention is made in view of the problem in the conventional electrical acoustic converter, and it is, therefore, an object of the present invention to provide a compact and thinned electrical acoustic converter.

To achieve the above object, the electrical acoustic converter comprises a base cover, an electromagnetic acoustic part attached to the base cover, a pair of coil contact springs for connecting the electromagnetic acoustic part with an outside power source and a pair of connecting chips formed on the base cover for connecting electrically the coil contact springs with the electromagnetic acoustic part.

The electromagnetic acoustic part includes a diaphragm extending diametrically of the base cover and a drive part having an exciting coil for causing the diaphragm to vibrate. The exciting coil has lead wires.

The coil contact springs are mounted within housings provided on portions of the base cover inward than an outer peripheral edge of the diaphragm.

Each of the coil contact springs has one end formed to extend horizontally. The horizontally extending one end and lead wires of the exciting coil are connected electrically at the connecting chips.

The connecting pieces are embedded in the base cover.

DETAILED DESCRIPTION OF THE PREFERRED EMBODIMENTS

Figure 1:
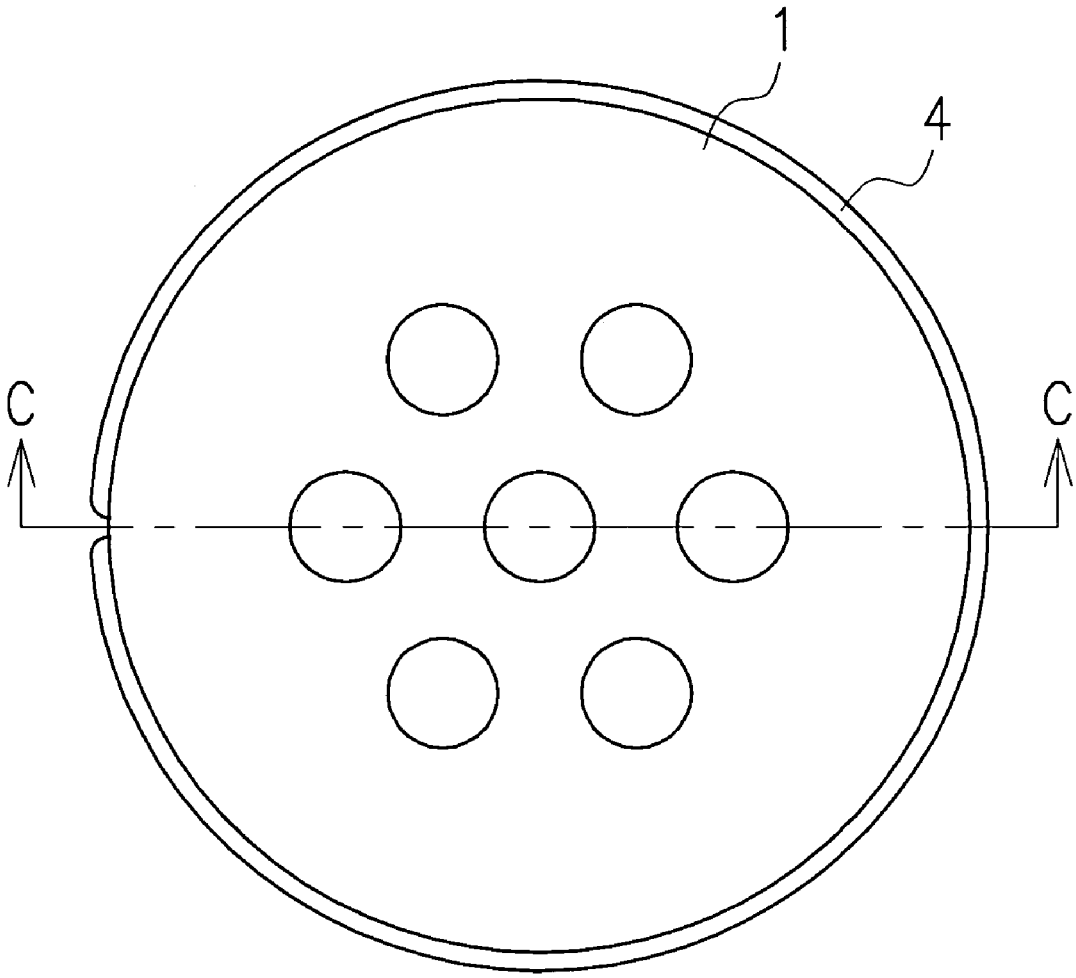
FIG. 1 is a plane view showing one embodiment of an electrical acoustic converter according to the present invention.

Some embodiments of the present invention will be explained with reference to the accompanying drawings below.

Referring to FIGS. 1 to 4, an electrical acoustic converter according to the present invention is illustrated. The electrical acoustic converter comprises a body part including a base cover 2 and a top cover 1 attached through a frame 4 to the base cover 2.

Disposed within a space formed between the top cover 1 and base cover 2 is an electromagnetic sound generating part which has a diaphragm 9 attached to the base cover 2 and a drive part causing the diaphragm 9 to vibrate, for example. The drive part includes a yoke 5 fitted to the base cover 2, a magnet 7 mounted on the yoke 5, a top plate 8 mounted on the magnet 7 and an exciting coil 6 disposed to oppose side surfaces of the magnet 7 and top plate 8.

Figure 2:
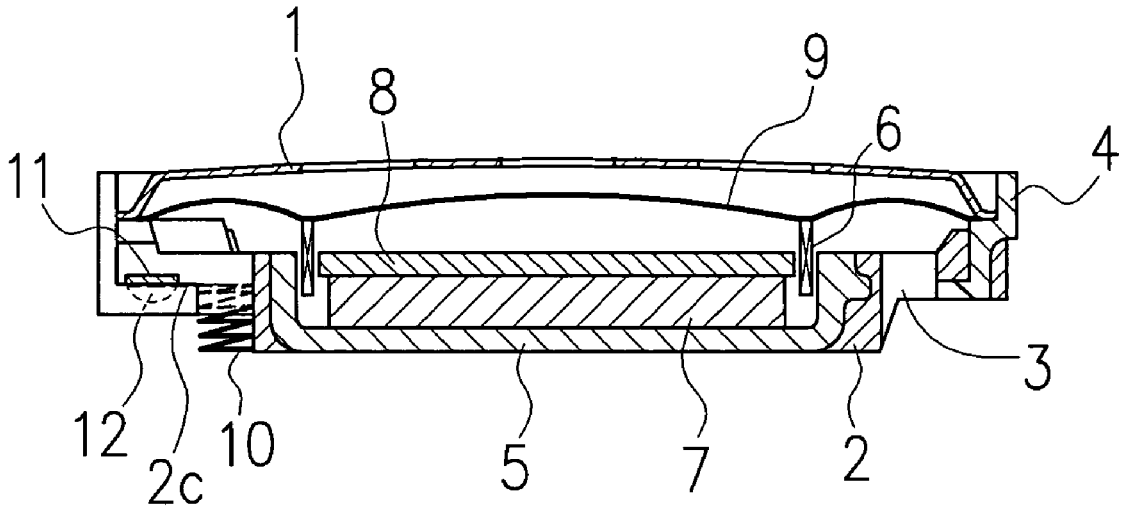
FIG. 2 is a sectional view taken along the line C—C in FIG. 1.
Figure 4:
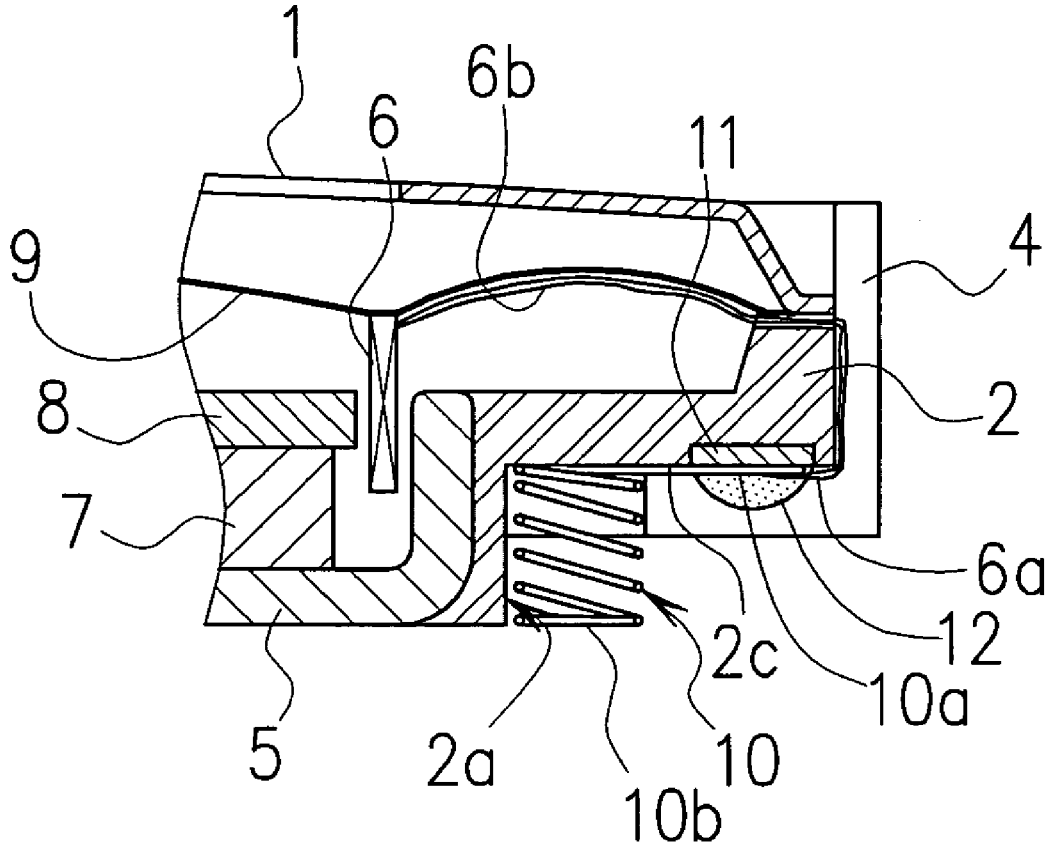
FIG. 4 is an enlarged sectional view taken along the line D—D in FIG. 3.
Figure 5:
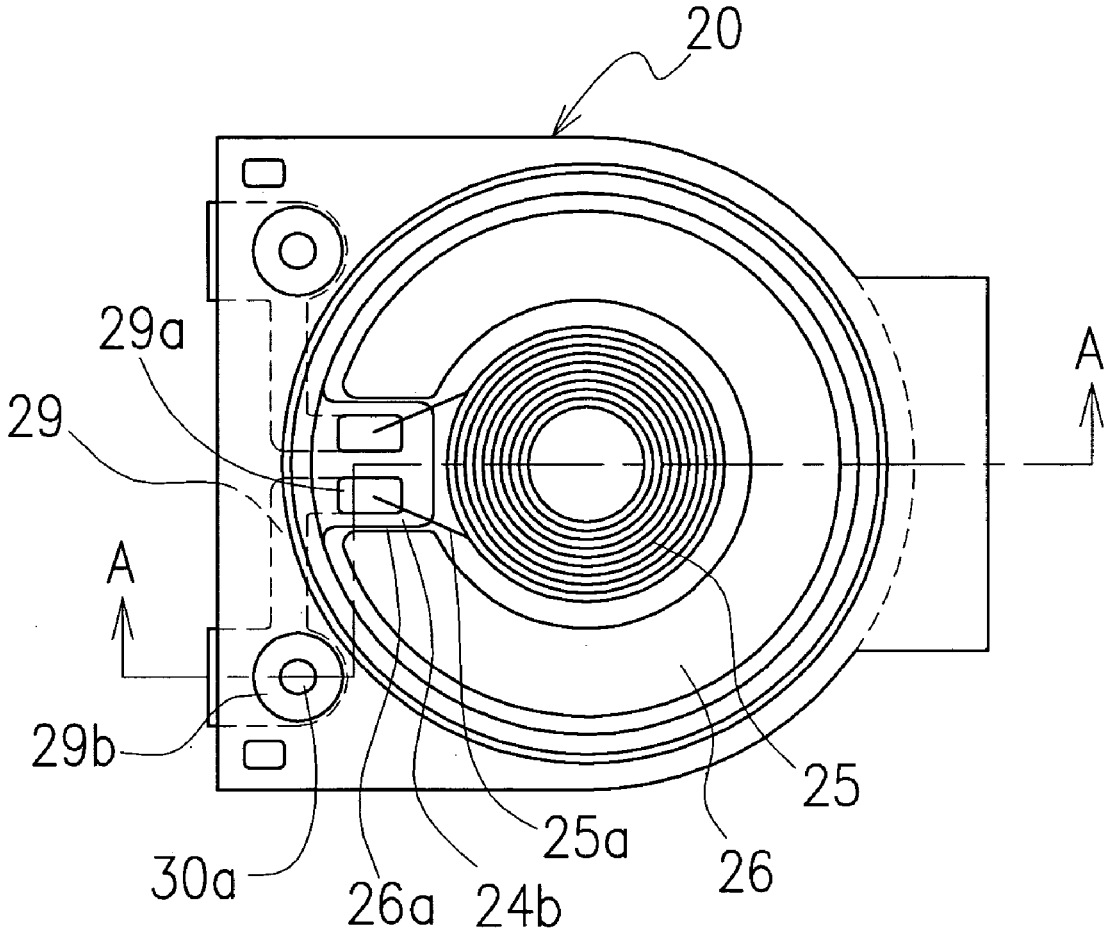
Fig. 5 (Prior Art)
FIG. 5 is a plane view showing a conventional electrical acoustic converter, with a top cover and a diaphragm removed.

Here, an upper end, for example, of the exciting coil 6 is attached to the diaphragm 9, as shown in FIGS. 2 and 4. When the exciting coil 6 is disposed as in the embodiment described above, it is possible to minimize a space in which the exciting coil 6 is occupied.

The top cover 1 is disposed to cover an upper surface of the diaphragm 9. Housings 2*a* for containing coil contact springs 10, which will be described below, are provided on portions of the base cover 2 inside of an outer peripheral edge of the diaphragm 9. In the illustrated embodiment, the housings 2*a* are arranged on a back surface 2*c* of the base cover 2 (see FIGS. 2 and 4).

Coil contact springs 10 are contained into the housings 2*a*. The coil contact springs 10 operate to connect the exciting coil 6 with an outside power source (not shown).

The base cover 2 is provided with a pair of connecting pieces 11 or lead frames which are used to connect the exciting coil 6 and coil contact springs 10. The connecting pieces 11 are arranged adjacent to the housings 2*a* and embedded in the back surface 2*c* of the base cover 2, in the illustrated embodiment (see FIGS. 3 and 4).

In addition, a plurality of sound-discharging holes 3 is formed in the back surface 2*c* of the base cover 2, spacing apart peripherally of the base cover.

Figure 3:
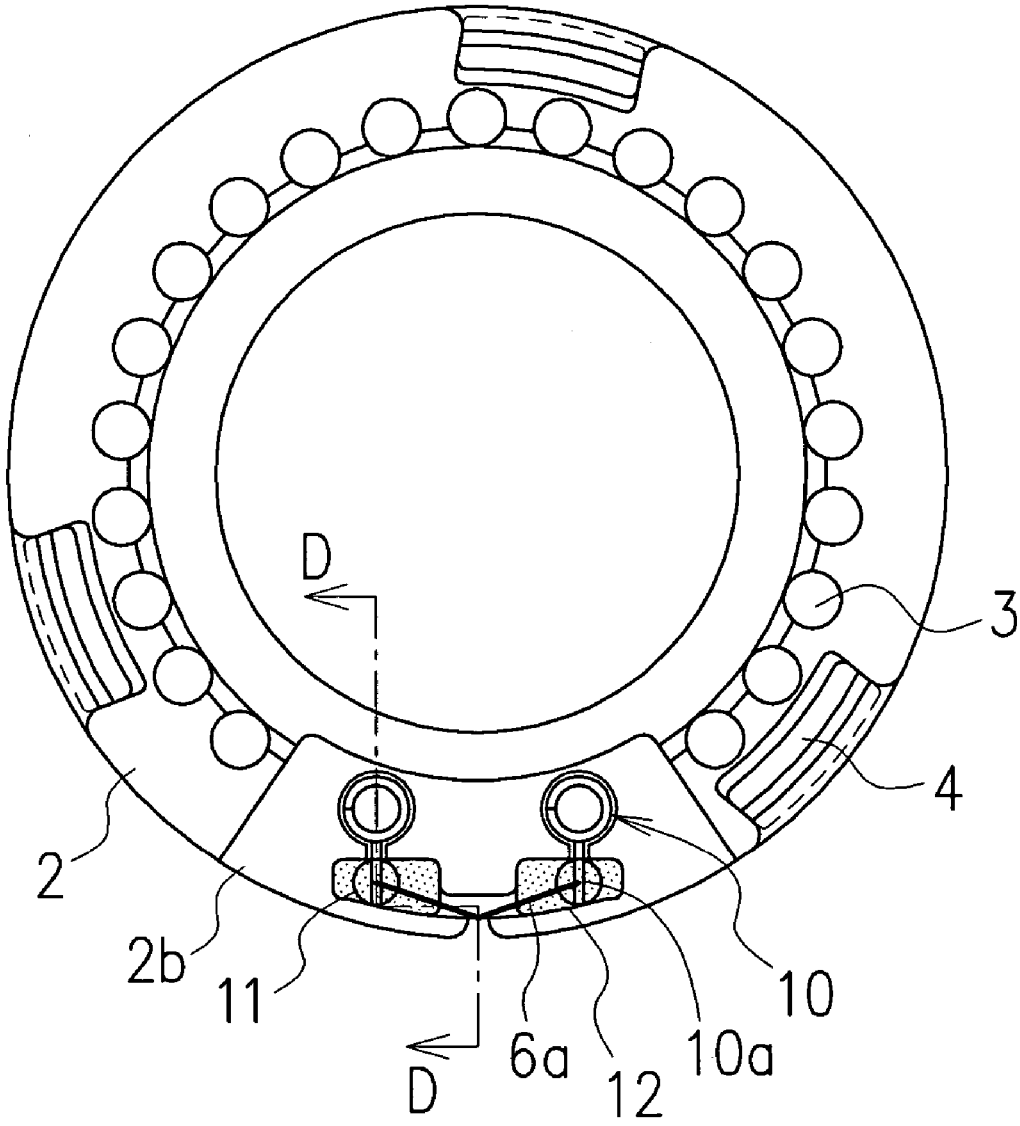
FIG. 3 is a back view of FIG. 2.

In FIGS. 3 and 4, the present invention is characterized in that the pair of coil contact spring housings 2*a* are formed near an inner periphery of the base cover 2 and portions of the base cover 2 inside of the outer peripheral edge of the diaphragm 9, and the pair of connecting pieces 11 or lead frames are formed in an embedded condition on the aforementioned portions of the base cover 2 by an injection molding for connecting contact parts or terminals 10*a* of the coil contact springs 10 as described below and ends or coil terminals 6*a* of lead wires 6*b* extending from the exciting coil 6 at the same place by a fixing means such as soldering or the like.

A portion of the base cover 2 has an exposed part 2*b* formed to be visible with the pair of coil contact spring housings 2*a* and connecting pieces 11.

Additionally, it should be noted that the fixing means is not limited to the soldering, instead, welding or pressure bonding may be available.

It should be noted that one end or the terminal 10*a* of each of the coil contact springs 10 extends horizontally and straightly, as shown in FIG. 4.

Figure 6:
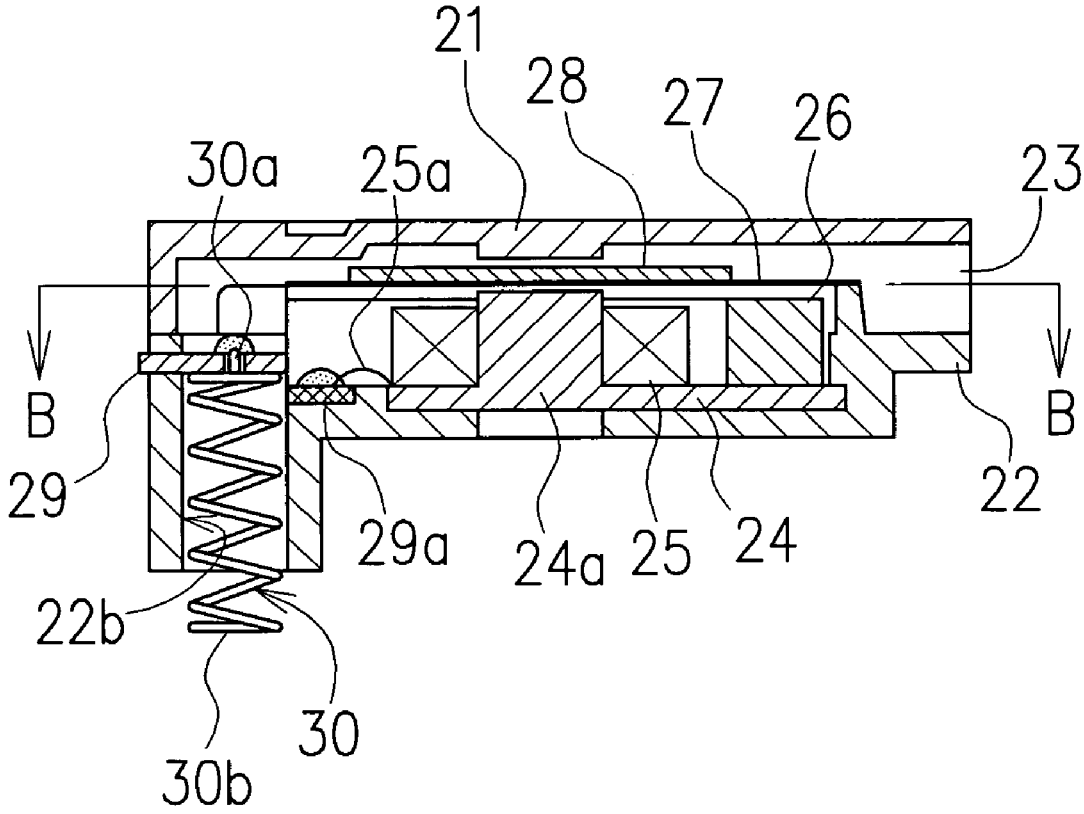
Fig. 6 (Prior Art)
FIG. 6 is a sectional view taken along the line A—A in FIG. 5.

In the prior art shown in FIG. 6, the terminal of each coil contact spring extends perpendicularly, or in directions of expansion and contraction of the coil contact spring.

On the contrary, the terminal 10*a* of the coil contact spring 10 extends perpendicularly to the directions of expansion and contraction of the coil contact spring and extends horizontally from an end 6*a* of a winding body of the coil contact spring 10, in the aforementioned embodiment of the present invention.

Another end of the coil contact spring opposite to the terminal 10*a* is formed with a terminal 10*b* for connecting the coil contact spring with an outside power source. The terminal 10*b* is disposed to be projected from the coil contact spring housing 2*a* when the coil contact spring 10 is inserted into the coil contact spring housing 2*a* and the terminal 10*a* is soldered to the connecting piece 11, as described above.

As shown in FIG. 4, each of the lead wires 6*b* extending from the exciting coil 6 extends along the diaphragm 9 above an upper surface of the base cover 2, and then passes along the outer peripheral edge of the base cover 2 and extends at the back surface of the base cover 2 onto the connecting pieces 11.

The terminals 10*a* of the coil contact springs 10 and coil terminals 6*a* of the exciting coil 6 are connected at the connecting pieces 11 or the same places by solders 12 or the like. In this way, the terminals 10*a* of the coil contact springs 10 and the terminals 6*a* of the exciting coil 6 are fixed stably and firmly on the connecting pieces 11.

The connection of the terminals 10*a* and 6*a* on the connecting pieces 11 may be carried out together simultaneously by means of any connecting means and may be carried out separately.

Next, a method of assembling the electrical acoustic converter as described above will be explained briefly.

As described above, the coil contact springs 10 are inserted into the coil contact spring housings 2*a* which are provided on the portions of the base cover 2 inside of the outer peripheral edge of the diaphragm 9. In this case, the horizontally extending terminals 10*a* of the coil contact springs 10 are disposed to be on the connecting pieces 11.

Simultaneously, the coil terminals 6*a* of the exciting coil 6 are drawn out to be on the connecting pieces 11 so that the terminals 10*a* and 6*a* are connected at the connecting pieces 11 by the solders 12.

In the prior art, the coil contact springs 10 are disposed outside of the outer peripheral edge of the diaphragm 9, but, are disposed inside of the outer peripheral edge in the embodiment of the present invention and therefore a mini-size electrical acoustic converter can be achieved.

The present invention also makes it possible to provide a thinned electrical acoustic converter, because the terminals 10*a* of the coil contact springs 10 are formed to be extended horizontally and are soldered to the connecting pieces 11.

Moreover, in the prior art there is required a plurality of soldering places of each terminal of the exciting coil and each lead frame, and the terminals of the coil contact springs and lead frames. The present invention makes it possible to decrease the number of soldering processes because the terminals 6*a* and 10*a* of the exciting coil 6 and the coil contact springs 10 are soldered at one place, together.

According to the present invention, as described above, the soldering process is minimized and a stable and firm installation can be accomplished, so it is possible to provide a thinned and compact electrical acoustic converter.

What is claimed is:

1. An electrical acoustic converter, comprising:

a base cover;

an electromagnetic sound-generating part having a diaphragm which is disposed to extend in a radial direction of said base cover and which is attached to said base cover;

a pair of coil contact springs provided on said base cover for connecting said electromagnetic sound-generating part with an outside power source; and a pair of connecting pieces provided outside said base cover for electrically connecting said coil contact springs with said electromagnetic sound-generating part, said electromagnetic sound-generating part including a drive part which has an exciting coil and causes the diaphragm to vibrate, said exciting coil having lead wires, said coil contact springs being contained in housings provided on outside portions of the base cover and within an outer peripheral edge of the diaphragm in plan view, each of the coil contact springs having one end formed to extend horizontally, and an end of each of the lead wires extending from the exciting coil along the diaphragm and around an outside end of the base cover, and said horizontally extending end of each coil contact spring and the end of each of the lead wires extending from the exciting coil being electrically connected at each of said connecting pieces.

2. The electrical acoustic converter according to claim 1, wherein it has a frame attached to the base cover and a top cover attached to the frame.

3. The electrical acoustic converter according to claim 1, wherein said pair of connecting pieces are embedded in the base cover.

4. The electrical acoustic converter according to claim 1, wherein said exciting coil is attached to the diaphragm.

5. The electrical acoustic converter according to claim 1, wherein said drive part has a magnet attached to the base cover and a top plate mounted on the magnet and disposed to oppose the diaphragm, wherein said exciting coil is disposed to face a side surface of the magnet.

6. The electrical acoustic converter according to claim 1, wherein the housings for the coil contact springs are disposed in a bottom surface of the base cover.

7. The electrical acoustic converter according to claim 1, wherein said horizontally extending end of each coil contact spring is connected directly to the end of a respective lead wire at a single connection point.

* * * * *